United States Patent [19]

Boehmig

[11] 3,952,472

[45] Apr. 27, 1976

[54] JOINT FOR TRANSFERRING BENDING MOMENTS

[76] Inventor: Robert L. Boehmig, 3030 Peachtree Road, Atlanta, Ga. 30305

[22] Filed: Dec. 6, 1974

[21] Appl. No.: 530,450

Related U.S. Application Data

[60] Continuation of Ser. No. 295,216, Oct. 5, 1972, abandoned, which is a division of Ser. No. 103,665, Jan. 4, 1971, Pat. No. 3,722,169.

[52] U.S. Cl. ..... 52/648; 52/258 B

[51] Int. Cl.[2] ..... E04B 1/35

[58] Field of Search ..... 52/126, 648, 649, 650, 52/283, 236, 758 B, 758 A, 721, 726, 235; 403/186

[56] References Cited

UNITED STATES PATENTS

| | | | |
|---|---|---|---|
| 2,084,648 | 6/1937 | MacMillan | 52/648 |
| 2,675,895 | 4/1954 | Loewenstein | 52/648 |
| 3,058,264 | 10/1962 | Varlonga | 52/283 |
| 3,435,583 | 4/1969 | Ben-Aziz | 52/745 |

*Primary Examiner*—John E. Murtagh

[57] ABSTRACT

A joint for attaching a horizontal beam to a vertical column in either a shear connection or a moment connection. A continuous beam is manufactured comprising main beam portions in end-to-end alignment with the opposed ends spaced to define the ends of joint openings. A pair of opposed channel members define the sides of each joint opening, the channel members being attached to said main beam portions by moment connections. The vertical column extends through the joint opening, and the channel members are bolted to the column (shear connection) or welded to the column (moment connection).

13 Claims, 21 Drawing Figures

50
48
65
50a
67
68
54
70
70
60
46
-52-
-52-
54a
62
66
50
65
50a 50
46
48
68
54
54a
60
62
50a
64
66
70
70

50
62
54
46
58
67
-52-
-52-
66
60
68
50
50
50
46
48
50
72
46
-52-
-52-
72
48
72
50

JOINT FOR TRANSFERRING BENDING MOMENTS

RELATED APPLICATIONS

This application is a continuation of application Ser. No. 295,216, filed Oct. 5, 1972, now abandoned, which is itself a division of Application Ser. No. 103,665 filed Jan. 4, 1971, now U.S. Pat. No. 3,722,169.

BACKGROUND OF THE INVENTION

1. Field of the Invention

The present invention relates to the field of building construction and more particularly to the joints between vertical columns and horizontal beams, and is particularly useful in lift-slab type construction for multi-story structures.

2. Description of the Prior Art

The joints between vertical columns and horizontal beams are of two categories, depending upon the desired transmission of loads from the beam to the column. Conventional construction methods have utilized structural steel frameworks for individual floors, by assembling the steel members at succeeding story heights above ground level. The complexity of total assembly of the components at each succeeding higher elevation is apparent. Generally speaking, this type of construction has utilized beams which are discontinuous at the columns, the beams being merely bolted to the column flanges to act as a shear type connection. If the design of the structure required a moment type connection utilizing a continuously acting beam, rather than a shear type connection, the beam ends were welded to the column and flanges and fillers were provided to extend between the column flanges such that after the fillers were welded in place, the joint would cause rotation of the column in response to rotation of the beam. Thus, the constructional requirements for a moment type connection were vastly different than the structural requirements for a shear type connection. The prior art contains many teachings for the construction of shear joints and moment joints, but simplicity and versatility have not been key factors. Quite importantly, the prior art teachings are not generally usable in the case of modern lift-slab construction techniques.

SUMMARY OF THE INVENTION

The instant invention is aimed at alleviating the above stated problems. In this regard, it is an object of the invention to provide a joint construction that is simple, effective, versatile relocatable. It is a further object of the invention to provide a joint wherein the beam is continuous through the joint. Another object of the invention is to provide a joint that is easily accomplished. Another object of the invention is to provide a continuous beam structure that permits vertical movement of the floor element relative to the vertical columns after the floor element has been constructed for use in lift-slab construction. Still another object of the invention is to provide a beam construction which facilitates either shear or moment type connections between the continuous beam and the support columns.

The invention is not restricted to any particular type of floor construction, and allows a floor to be a structurally stable unit that can be elevated from its initial position to a final position in the manner of conventional lift-slab construction. Typical floor constructions utilize a steel beam frame upon which a wooden or metal floor is placed, or a steel beam frame having a concrete floor poured on or within the confines thereof in the manner presently used in the art for constructing floors of non-lift-slab type conventional steel frame buildings.

The above stated objects, aims and purposes are accomplished by the construction of a beam that is continuous across the joint with the column. Such a beam is assembled of a pair of elongated main beam portions disposed in longitudinal alignment with their opposed ends spaced to define an elongated gap therebetween. A pair of spanning beam portions are disposed in opposed, spaced, relationship to define the sides of the elongated gap. Means are provided for rigidly interconnecting the extremities of the spanning beam portions with the respective ends of the main beam portions to construct a continuous beam disposed in horizontally extending relationship with the gap opening vertically for receiving a vertical column therethrough. Means are also provided for connecting the column to the beam. A moment type beam-to-column connection is easily produced by welding together the column and the spanning beam portions. A shear type beam-to-column connection is easily produced by bolting or riveting the spanning beam portions to the column. The beam structure and joint are equally applicable to conventionally constructed steel building or to lift-slab construction with the unique advantage that continuous type floor beams can be utilized which transmit no bending moments to the columns. It permits the entire floor assembly to be lifted into place with standard lifting devices pertinent to the lift-slab type of construction.

It should be understood that the term "continuous beam" is a term of art and it is intended herein to be defined in accordance with the usual definition it is given in the art of building construction. That is, a "continuous beam" is a beam whose behavior characteristics are those of a beam comprised of a single member or piece, even though the "continuous" beam may actually comprise a plurality of members or pieces. The various portions of a multimember continuous beam are attached together by "moment connections", as opposed to "shear connections". A "moment connection", as defined in the art, is one in which the bending effects of a load applied on one side of the joint is transmitted to the other side of the joint across the full cross-section of the beam. Thus, for example, a load tending to cause tension at the upper extremity and compression at the lower extremity of a beam portion on one side of the joint, will cause the same internal forces to be generated on the beam portion that is on the other side of the joint.

It should further be understood that this invention involves two connections. The first connection is a beam-to-beam connection between the various beam portions, in order to construct a continuous beam. The beam-to-beam connections must be moment connections. The second connection is the beam-to-column connection between the assembled continuous beam structure and the column. The beam-to-column connection may be a moment connection or a shear connection.

A joint constructed in accordance with this invention permits simple transfer of bending moments across each column without introducing complicated strengthening arrangements associated with conventional practice which heretofore have prohibited vertical relocation of the joints.

DESCRIPTION OF THE PREFERRED EMBODIMENTS

Figure 1:
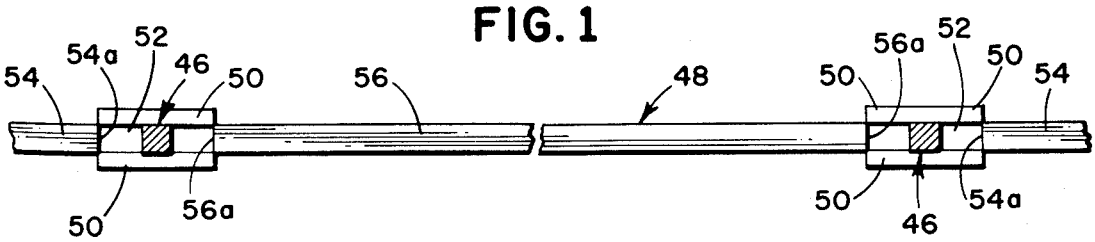
FIG. 1 is a fragmentary top plan view of a structural steel beam constructed in accordance with the concepts and principles of the invention.
Figure 2:
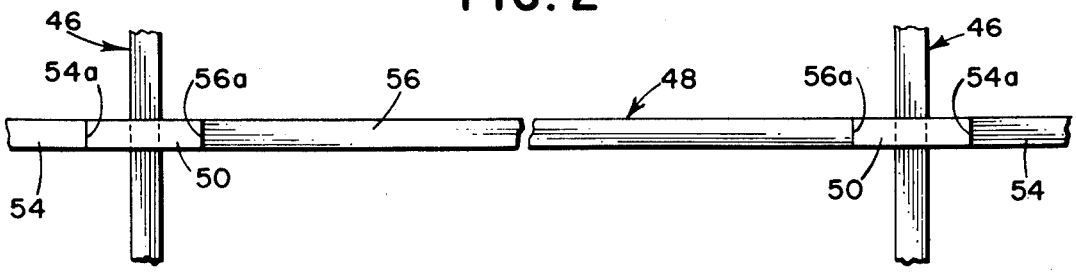
FIG. 2 is a fragmentary side elevational view of the beam of FIG. 1.

The overall structure of the intersection between a continuous horizontal beam generally labeled 48 and a vertical column 46 in accordance with the teachings of this invention is illustrated in FIGS. 1 and 2. Beam 48 comprises a pair of elongated spanning beam portions 50, which are disposed in laterally spaced, generally parallel relationship to one another, presenting an elongated gap 52 therebetween. Beam 48 also comprises a first elongated main beam member 54 disposed in general parallelism to portions 50. Member 54 has an extremity 54*a* disposed at one end of gap 52. Each beam 48 also comprises a second elongated main beam member 56. Member 56 is disposed in longitudinal aligned relationship to corresponding member 54, and has an extremity 56*a* disposed at the opposite end of gap 52 from the corresponding extremity 54*a*. Each of the extremities 54*a* and 56*a* are disposed centrally of the corresponding ends of the portions 50. This arrangement of portions 50, member 54 and member 56 completes a continuous moment transfer around column 46.

Generally speaking, spanning beam portions 50 may be constructed of channels while main beam members 54 and 56 may comprise I-beams or other wideflange sections. In FIGS. 3–6 column 46 is shown as comprising an I-beam disposed with its central web 58 extending longitudinally of beam 48.

Figures 3, 4, 5, 6, 7, 8:
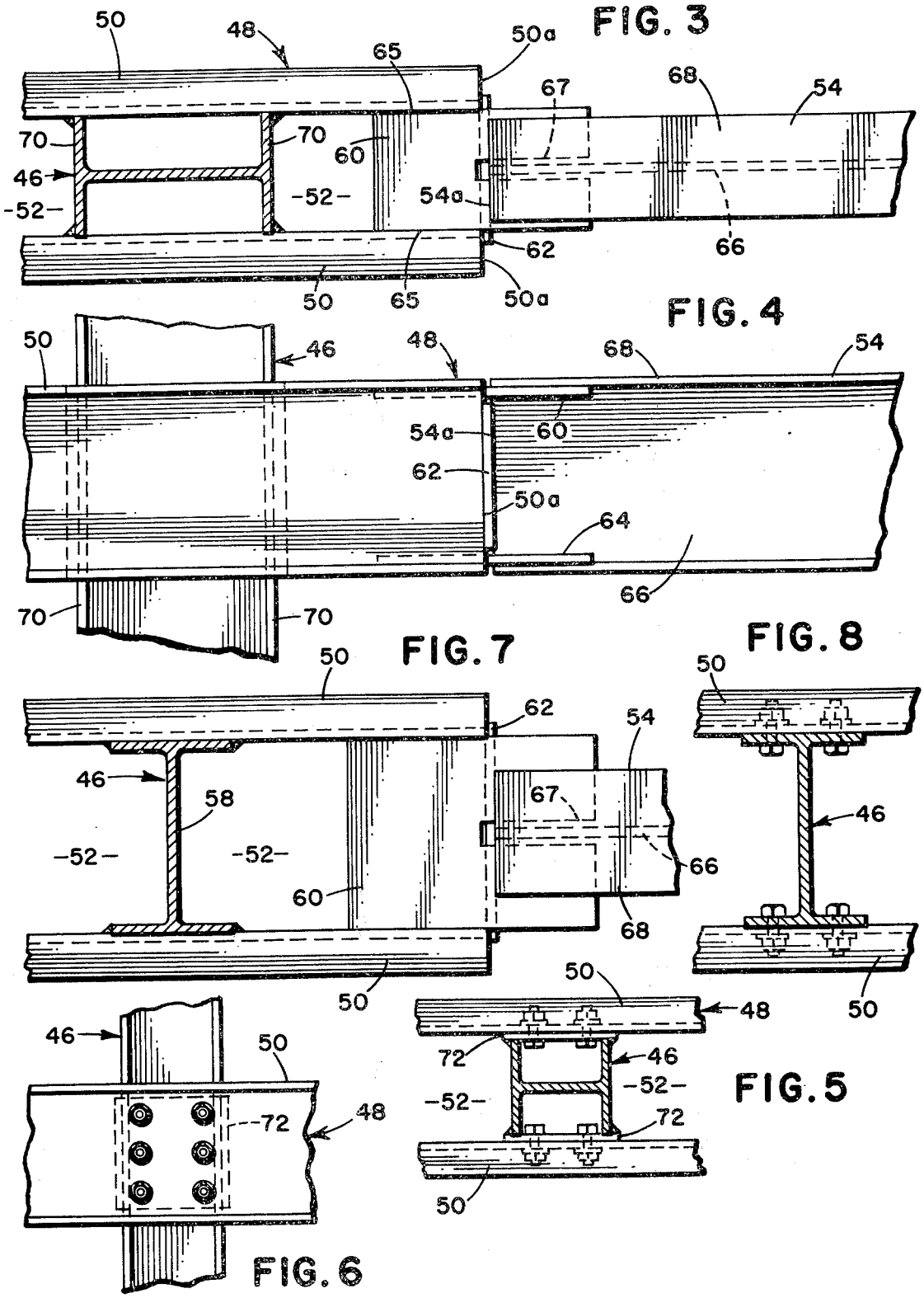
FIG. 3 is an enlarged fragmentary top plan view of the connection between the beam and a column wherein the beam is welded to an I-beam column to present a moment type connection.
FIG. 4 is a side elevational view of the structure of FIG. 3.
FIG. 5 is a fragmentary top plan view of a connection similar to the structure of FIG. 3 except that the beam and the column are interconnected by bolt and nut means to present a shear type connection.
FIG. 6 is a side elevational view of the structure of FIG. 5.
FIG. 7 is a fragmentary top plan view of a moment type connection structure similar to the structure of FIG. 3 except that the I-beam is rotated 90°.
FIG. 8 is a fragmentary top plan view of a connection similar to the structure of FIG. 7 except that the beam is bolted to the column to present a shear-type connection.

Beam member 54 is rigidly interconnected to beam portions 50 by beam joining means comprising three plates 60, 62 and 64 as best illustrated in FIGS. 3 and 4. Plate 60 exends transversely between channel 50 and longitudinally beyond the ends 50*a* thereof. Plate 60 is preferably attached to channels 50 by welding or the like along edges 65. A longitudinally extending slot 67 is provided in plate 60 for receiving the web 66 of I-beam 54. The upper flange 68 of I-beam 54 is then welded to plate 60. Plate 62 is welded in place between extremity 54*a* of beam member 54 and ends 50*a* of channels 50. The lower flanges of channels 50 and I-beams 54 are attached to plate 64 by welding or the like. This constitutes a moment connection between beam members 54 and channels 50.

Beam member 56 is attached to channels 50 at the opposite ends thereof in an identical fashion such that at each column 46, the member 54 the channels 50 and the member 56 act together as a continuous beam 48. Beam 48 extends horizontally with the gaps 52 opening vertically. Each gap 52 receives a column 46 extending therethrough. Each column 46 is rigidly inerconnected with a beam 48 so that the beam 48 may be supported by the column 46.

Figure 21:
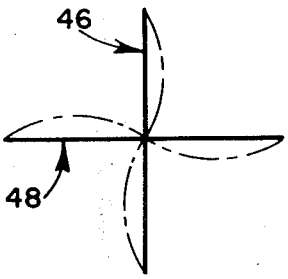
FIG. 21 is a schematic diagram of the moment-type action produced by the structures illustrated in FIGS. 3 and 4, 7, 9 and 17 and 19, the dashed lines on FIGS. 19, 20 and 21 indicate the deflected positions (exaggerated) of the loaded structure.

Viewing FIGS. 3 and 4, it can be seen that flanges 70 of the I-beam constituting column 46 are welded to channels 50. Thus, a moment type connection between beam 48 and column 46 is provided. That is to say, a clockwise rotation of beam 48 (FIG. 4) will cause a corresponding clockwise rotation of column 46. This is caused by the fact that beam 48 is not free to move relative to column 46. This moment-type action is schematically illustrated in FIG. 21.

Figure 20:
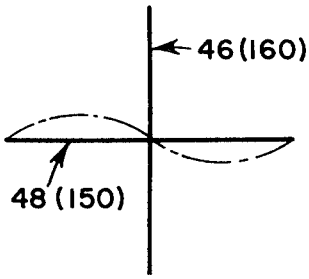
FIG. 20 is a schematic diagram of the shear-type action produced by the structures illustrated in FIGS. 5 and 6, 8 and 10.

In FIGS. 5 and 6, a shear-type connection between beam 48 and column 46 is illustrated where the components are substantially identical with the components of FIGS. 3 and 4. In addition, a bearing plate 72 is welded to each side of the I-beam column 46. Plates 72 are then bolted to channels 50. Thus, a clockwise deflection tending to rotate of beam 48 (FIG. 6) does not cause a corresponding clockwise rotation of column 46 because the interconnection between the bolts and the corresponding bolt holes permits a slight amount of movement of beam 48 relative to column 46. This shear-type action is schematically illustrated in FIG. 20.

In FIGS. 7 and 8, the column 46 is shown as an I-beam wherein the web 58 extends transversely of beam 48. In this embodiment also, column 46 may be welded (FIG. 7) or bolted (FIG. 8) to channels 50 to provide a moment-type connection wherein column 46 rotates with beam 48 (FIG. 7 and FIG. 21) or a shear-type connection wherein deflections tending to rotate of beam 48 do not cause a corresponding rotation of column 46 (FIG. 8 and FIG. 20).

Figure 9:
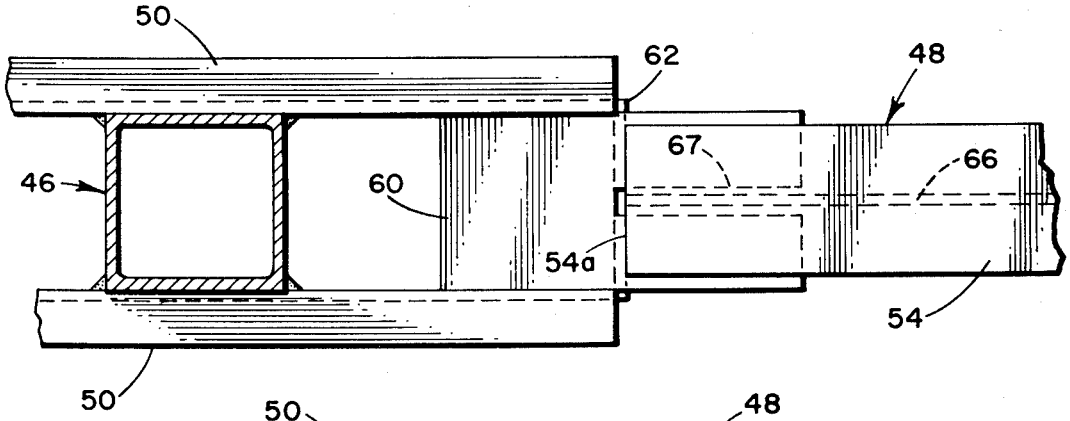
FIGS. 9 and 10 are enlarged, fragmentary top plan view of structures similar to the connections illustrated in FIGS. 3 and 5 respectively except that a box beam is utilized for the column rather than an I-beam.
Figure 10:
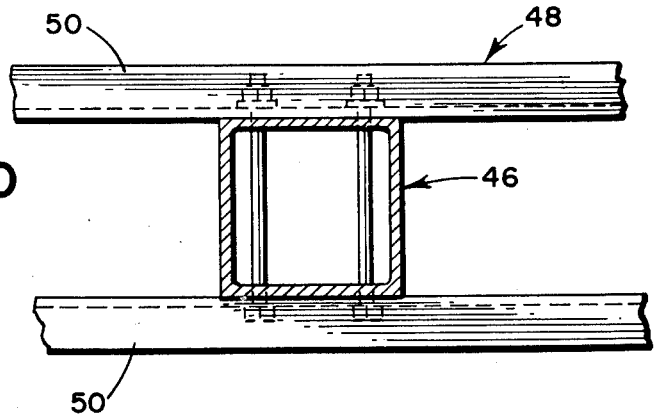

FIGS. 9 and 10 illustrate another embodiment of the invention wherein column 46 comprises a box-shaped section. In FIG. 9, column 46 is welded to channels 50 to provide a moment-type connection and in FIG. 10, column 46 is bolted to channels 50 to provide a shear-type connection.

Figure 19:
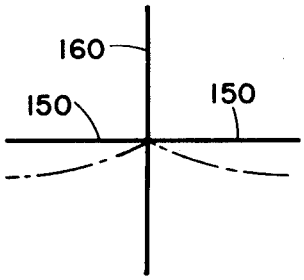
FIG. 19 is a schematic diagram illustrating the shear-type action of the connection of FIGS. 15 and 16.

The beams 48 of the invention provide efficiency and design flexibility in the construction of multi-story buildings which has not been possible in the past. This is best illustrated by comparing the structure of this invention with the structure of the prior art as shown in FIGS. 15–18. In the past, it was not uncommon to provide shear-type connections by merely terminating the beams 150 (FIGS. 15 and 16) at columns 160 and bolting beams 150 to columns 160 through the use of angle irons 170. The action of this type connection is illustrated schematically in FIG. 19. On the other hand, if a moment-type connection was desired, beams 150 were welded to column 160. Then filler plates 180 were installed in alignment with the flanges of beams 150 and were welded between the flanges of column 160. Thus, a rotational deflection of beam 150 would cause a corresponding rotational deflection of column 160 as illustrated schematically in FIG. 21. Manifestly, FIGS. 15–18 illustrate vividly that two different types of joint construction were required to achieve shear-type or moment-type connections. On the other hand, through the use of the instant invention, a single connection construction is utilized to produce a moment-type connection by welding the beam to the column or a shear-type connection by bolting the beam to the column.

The structure of the instant invention also facilitates lift-slab type construction. A structurally stable floor element, such as 32–42 which includes beams such as 48, constructed at one level and then elevated to another. The column-beam joint design presented by beam portions 50 and the extremities 54*a* and 56*a* of beam members 54 and 56 are movable relative to columns 46 to facilitate this elevation.

Figure 13:
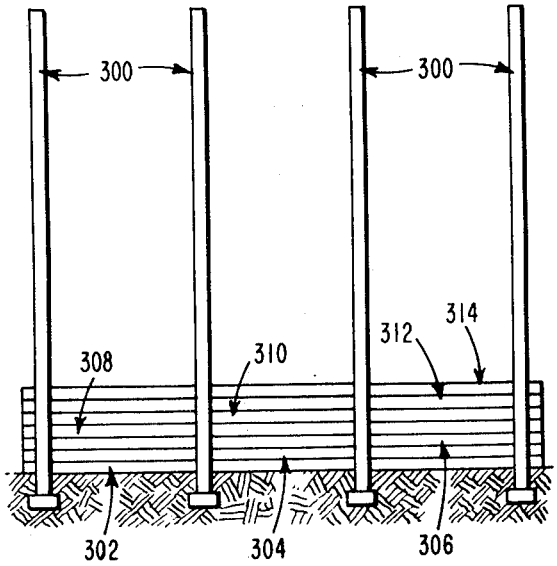
FIGS. 13 and 14 are views similar to FIGS. 11 and 12 illustrating a prior art method for construction of multistory building by the lift-slab method.
Figure 14:
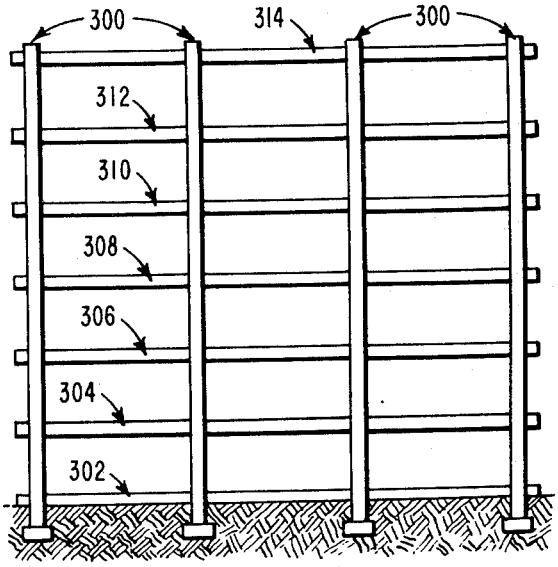
Figure 15:
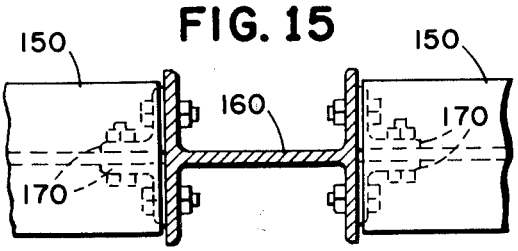
FIGS. 15 and 16 are a fragmentary top plan view and side elevational view respectively illustrating a prior art shear-type joint for interconnecting columns and beams.
Figure 17:
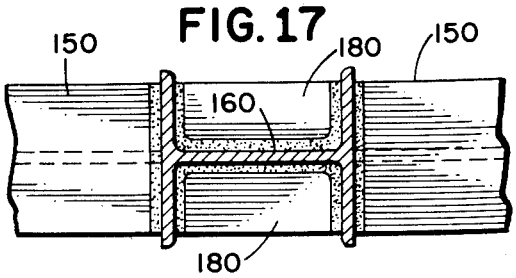
FIGS. 17 and 18 are a fragmentary top plan view and side elevational view, respectively, illustrating a prior art moment-type joint for interconnecting columns and beams.
Figure 16:
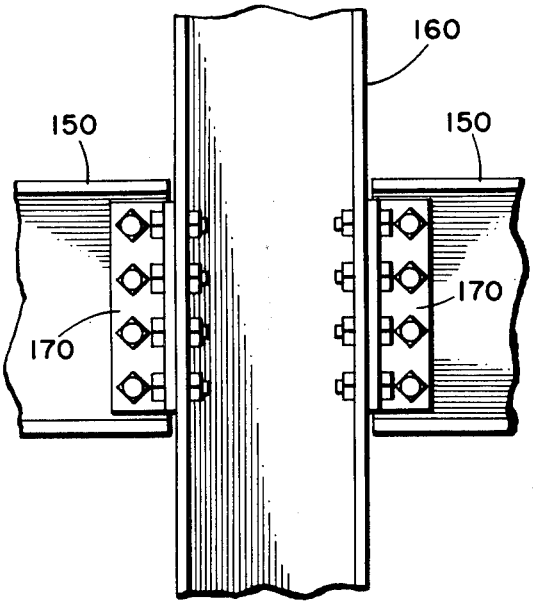
Figure 18:
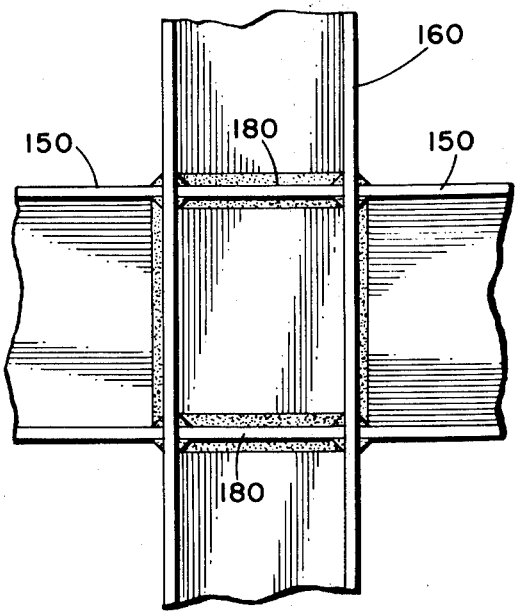

The ease of interconnecting beams 48 and columns 46 in accordance with the instant invention has also made possible a new method for construction of multi-story buildings. This method is illustrated in FIGS. 11 and 12 and provides many advantages not obtainable through the use of prior art methods, the most important of which is illustrated in FIGS. 13 and 14.

Figure 11:
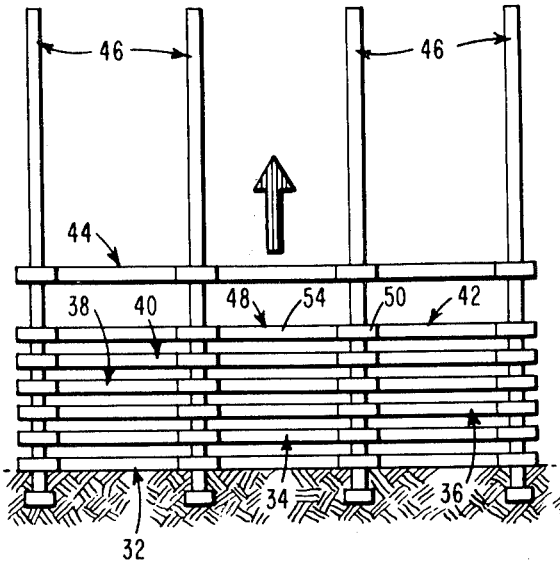
FIG. 11 is a side elevational view on reduced scale of a multi-story building construction illustrating the manner in which the individual floors are supported during the early stages of construction utilizing the method of the instant invention.
Figure 12:
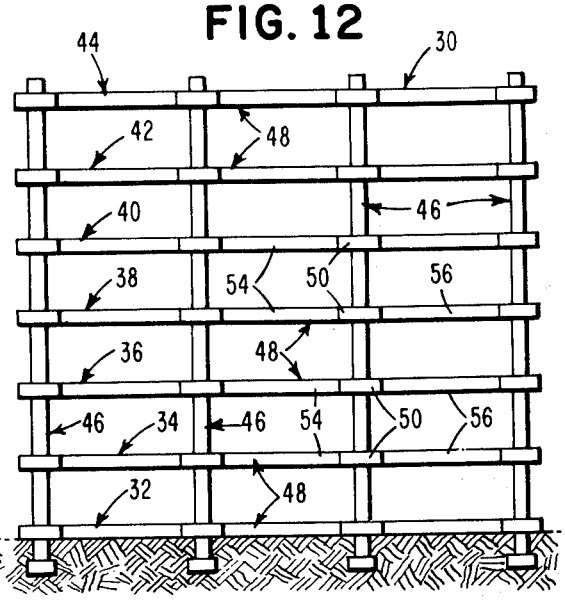
FIG. 12 is a side elevational view of the building construction after the floors have been constructed and elevated to their final positions.

Viewing FIGS. 11 and 12, a multi-story building is constructed in accordance with the instant invention by first erecting columns 46. A structurally stable floor element 32 is then constructed at or near ground level. Thereafter, a structurally stable floor element 34 is constructed at an elevation slightly above the elevation of element 32. Element 34 includes a plurality of beams 48 which may be preliminarily attached to columns 46 so that element 34 is supported by columns 46 during its construction. Thus, floor element 32 may serve to provide access to floor element 34 during construction of the latter. Further, floor element 32 does not have to be of sufficient strength to support floor element 34 during the construction of the latter since floor element 34 is supported by the columns 46.

Each of the structurally stable floor elements 32–42 consists of a framework that supports a floor surface. By way of example, the framework may be a steel beam construction upon which is installed conventional wooden or metal flooring in a known manner. A conventional concrete floor can be constructed upon or within the confines of the framework by providing suitable forms upon or around the sides and the bottom of the framework and pouring concrete therein as is well known in the field for constructing concrete floors in non-lift-slab type constructions. Openings in the floor surface are provided at each of the vertical support columns to facilitate removal of the temporary attachment means necessary for the practice of the method of this invention, slidable vertical movement of the floor elements to their final positions, and permanent attachment of the floor elements at their final position. Once the floor element is placed in final position, these openings can be closed. The concrete form is normally removed prior to moving the floor element to its final position.

Preliminary attachment of the structurally stable floor elements to the vertical support columns can be accomplished by temporary attachment means (not shown) now known in the field such as spot welding or bolting the framework directly to the vertical columns or by welding or bolting clip angle seats to the vertical columns, and supporting the framework on these seats. The temporary supports are removed prior to moving the floor element to its final position.

Movement of the floor elements to their final positions can be accomplished by any of the means now used in conventional lift-slab construction such as hoists and jacks.

The remaining floor elements 36–42 are constructed in seriatim and each is supported solely by columns 46 during the construction thereof. In each case, each floor element provides access facilitating the construction of the next higher floor element and yet, none of the floor elements must be designed to support any of the succeeding floor elements during the construction thereof. The floor elements can be constructed as close together as a few inches, or spaced apart enough to allow persons access to the underside of the upper element. After all of the floor elements have been constructed, each is elevated in reverse order to its final elevation.

The joint of the instant invention can also be used in other types of lift-slab construction, as illustrated in FIGS. 13 and 14. In this method, the columns 300 are erected and then the floors 302–314 are constructed one after another. Floor 302 is constructed and then floor 304 is constructed and is supported by floor 302. Thereafter floor 306 is constructed and is supported by floors 304 and 302. Each succeeding floor is constructed on top of the floors already constructed and is supported by the lower floors.

It should be noted that it is not necessary to use concrete slabs or structural framing of uniform thickness when utilizing the joint of this invention, as is the case with prior art joints. This is because there is no requirement that the bottom surface of the slab or framing be at the same elevation as the construction below, since access to the joint is not restricted by the slab itself. This joint also provides a passage for vertical utility lines, greatly simplifying their design and installation.

While variations and modifications of the above preferred embodiments of the invention will doubtless come to mind to those skilled in the art, the invention is not limited to these preferred embodiments, but is governed only by the scope of the appended claims.

I claim:

1. A joint for transferring bending moments comprising:

an elongated rigid continuous beam structure comprising first and second elongated main beam members disposed in longitudinally aligned relationship to one another and terminating, respectively, in first and second ends spaced apart longitudinally to define therebetween an elongated gap for accomodating a vertical column, and a pair of elongated spanning beam portions of sufficient length to span said gap disposed in opposed spaced relationship to one another and defining the sides of said gap, said spanning beam portions being attached to said main beam members by moment connections to provide a continuous rigid beam structure across said gap;

a vertical column extending through said gap, the cross-sectional dimensions of said vertical column and said gap being such that said beam structure is relatively movable with respect to said column so as to be relocatable vertically along said column; and fastening means connecting said column to said spanning beam portions.

2. A structure as set forth in claim 1 wherein said spanning beam portions each include a substantially flat surface facing said gap, said column engaging said surfaces.

3. A structure as set forth in claim 2 wherein each column includes a flat area and said fastening means comprises bolt and nut means extending through said column and said spanning beam portions.

4. A structure as set forth in claim 2 wherein said fastening means comprises weld bead means attaching said column to said surfaces.

5. A structure as set forth in claim 2 wherein said spanning beam portions comprises steel channels.

6. A structure as set forth in claim 1 wherein said column is I-shaped in cross-sectional configuration.

7. A structure as set forth in claim 1 wherein said column is boxshaped in cross-sectional configuration.

8. An elongated rigid continuous beam structure comprising:

first and second main beam members disposed in end-to-end relationship and in substantial longitudinal alignment and defining the ends of a first joint opening between opposed ends of said first and second main beam members, a first pair of opposed, laterally spaced spanning beam portions positioned at said first joint opening to define the sides thereof, said spanning beam portions being attached to said main beam members by moment connections to provide a continuous rigid beam structure across said first joint opening, said first joint opening being for the purpose of receiving a column for attachment to said spanning beam portions at said first joint opening.

9. A structure as set forth in claim 8 further comprising a third main beam member disposed in end-to-end relationship and in substantial longitudinal alignment with said second main beam member to define the ends of a second joint opening between opposed ends of said second and third main beam members, a second pair of opposed, laterally spaced spanning beam portions positioned at said second joint opening to define the sides thereof, said spanning beam portions of said second pair being attached to said second and third main beam members by moment connections to provide a continuous rigid beam structure across said second joint opening.

10. A structure as set forth in claim 8 wherein each of said spanning beam portions comprises a channel member with the base thereof forming a side of said joint opening.

11. A structure as set forth in claim 10 wherein said channel members at each said joint opening are parallel to one another.

12. A structure as set forth in claim 10 further comprising beam joining means for attaching said main beam members to the respective spanning beam portions by moment connections, said beam joining means being attached to said spanning beam portions and to said main beam members.

13. A structure as set forth in claim 12 wherein each said main beam member comprises a beam web and first and second beam flanges attached to said web, and each said beam joining means comprises a first plate attached to said first beam flange and to both of said channel members, a second plate attached to said second beam flange and to both of said channel members, and a third plate attached to the web portion of both of said channel members and to said beam web.

* * * * *